US005573334A

United States Patent [19]

Anderson

[11] Patent Number: 5,573,334

[45] Date of Patent: Nov. 12, 1996

[54] METHOD FOR THE TURBULENT MIXING OF GASES

[75] Inventor: Roger N. Anderson, San Jose, Calif.

[73] Assignee: Applied Materials, Inc., Santa Clara, Calif.

[21] Appl. No.: 454,762

[22] Filed: May 31, 1995

Related U.S. Application Data

[62] Division of Ser. No. 984,403, Dec. 2, 1992, Pat. No. 5,523,063.

[51] Int. Cl.[6] ..... B01F 3/02; B01F 5/04

[52] U.S. Cl. ..... 366/162.4; 366/165.1

[58] Field of Search ..... 366/101, 107, 366/137.1, 162.1, 162.4, 165.1, 165.2, 165.4, 165.5, 167.1, 173.1, 176.1, 177.1, 181.6, 184, 336, 338; 137/2, 3, 896; 422/133, 224

[56] References Cited

U.S. PATENT DOCUMENTS

| | | | |
|---|---|---|---|
| 2,043,108 | 6/1936 | Maurer | 366/165.4 |
| 3,391,908 | 7/1968 | MacDonald . | |
| 3,833,718 | 9/1974 | Reed et al. | 366/162.4 X |
| 4,002,293 | 1/1977 | Simmons | 239/11 |
| 4,087,862 | 5/1978 | Tsien | 366/165.1 |
| 4,089,630 | 5/1978 | Vollerin et al. . | |
| 4,092,013 | 5/1978 | Staaf | 366/165.4 |
| 4,415,275 | 11/1983 | Dietrich | 366/165.1 |
| 4,474,310 | 10/1984 | Muller et al. | 222/145 |
| 4,480,925 | 11/1984 | Dietrich | 366/107 |
| 4,505,592 | 3/1985 | Ihbe et al. | 422/133 X |
| 4,521,117 | 6/1985 | Ouwerkerk et al. | 366/165.1 X |
| 4,632,314 | 12/1986 | Smith et al. | 239/433 |
| 4,726,686 | 2/1988 | Wolf et al. | 366/165.1 |
| 4,865,820 | 9/1989 | Dunster et al. . | |
| 4,895,452 | 1/1990 | Yiourhas et al. | 366/165.1 |
| 5,113,028 | 5/1992 | Chen et al. . | |

*Primary Examiner*—Charles E. Cooley
*Attorney, Agent, or Firm*—Shirley L. Church; Charles S. Guenzer; Lawrence Edelman

[57] ABSTRACT

An apparatus and method for the turbulent mixing of gases are described. The invention has particular application when it is desired to produce a gas mixture including a very small quantity (ppm or less) of at least one component gas and/or wherein there is a substantial density difference between the component gases to be used to make up the gas mixture. The apparatus comprises: a tubular housing; at least two orifices or jets located near one end of the housing, through which gases to be mixed can enter the interior of the housing, the orifices or jets being oriented so that a first portion of gas flowing from a first orifice or jet will directly impact a second portion of gas flowing from a second orifice or jet, whereby frictional mixing of the gas components is achieved, further, the centerline of the first orifice or jet is offset from the centerline of the second, opposing orifice or jet, so as to produce a swirling action within the tubular interior of the gas mixer; and an exit opening at the opposite end of the tubular housing.

3 Claims, 4 Drawing Sheets

METHOD FOR THE TURBULENT MIXING OF GASES

This application is a Divisional Application of prior U.S. application Ser. No. 07/984,403, filed Dec. 2, 1992 , now U.S. Pat. No. 5,523,063.

BACKGROUND OF THE INVENTION

1. Field of the Invention

The present invention relates to an apparatus and method for the turbulent mixing of gases. The apparatus comprises a tubular structure having at least two orifices or jets on the internal surface thereof. The orifices or jets are opposed in a manner such that gas streams flowing through these openings into the interior of the tubular structure are mixed in a turbulent manner. In particular, the relative locations of the orifices or jets on the interior surface of the tubular structure provide a swirling flow pattern which is particularly effective in its mixing action.

2. Description of the Background Art

There are numerous requirements for specialized gas mixing apparatus and methods, particularly when a desired gas mixture is not available commercially. Frequently a gas mixture is not available commercially because the gases to be mixed are reactive. It may be the gases have significantly different densities and would separate on standing of the mixture. In the case of reactive gases or gas mixtures where density difference is a problem, it is preferable to use the gas mixture immediately after mixing. Specialized mixing apparatus may be required when one of the gases in the mixture is present in a relatively low concentration, increasing the difficulty of preparing a homogeneous mixture. For some applications, the gas mixing apparatus can have moving internal parts or stationary internal parts which assist in the mixing of the gases. However, for applications in which contamination of the gas mixture due to the erosion or corrosion of such internal parts is a critical factor, it may be necessary to avoid the presence of such internal parts. Further, internal parts may also provide a corner, crevice or dead space which permits particle accumulation.

Chen et al., in U.S. Pat. No. 5,113,028, issued May 12, 1992, describe a process for mixing hot ethane with chlorine gas using a tubular (pipe) mixer having no internal parts. Ethane gas is conducted through a main pipe, and chlorine gas is introduced into the main pipe through four or more jets. The angle between the axis of each jet and the line from the center point to the point where the axis of each jet makes contact with the inside surface of the main pipe ranges between about 30° to 45° . After the introduction of the chlorine gas, the combination of ethane and chlorine gas travel coaxially through the pipe to complete mixing, with a reaction taking place when the gas mixture reaches an appropriate temperature. The length of the pipe is at least 10times the diameter of the pipe; the ratio of the pipe diameter to the jet diameter ranges from about 21:1to 8:1; the velocity of the gases traveling through the pipe is less than the speed of sound, but such that the Reynolds number for each gas is at least 10,000; and, the ratio of the chlorine gas velocity to the ethane gas velocity ranges from approximately 1.5:1to 3.5:1. The mixer is designed to insure sufficient friction between the gases during mixing that the temperature of the mixture of gases, without any heat due to chemical reaction, reaches a temperature of approximately 225° C. or higher after mixing. It is this latter requirement that determines the relative velocities of the gases passing through the mixer and the requirement that there be at least four jets positioned as described around the circumference of the pipe.

Another gas mixing apparatus having no internal parts which contribute to the mixing is described by Dunster et al. in U.S. Pat. No. 4,865,820, issued Sept. 12, 1989. This apparatus is a combination gas mixing and distribution device. The mixer - distributor is used to feed a gaseous mixture to a hydrocarbon reforming reactor. A principal feature of the apparatus is that the apparatus mixing section provide turbulent gas flow, to ensure substantial mixing of the gases, and that the gas mixture velocity within the apparatus distributor section exceed the flashback velocity of a potential flame from the reaction chamber into the mixing chamber. The gas mixer comprises a plurality of tubes inside a chamber, wherein each tube has a plurality of orifices which communicate with the surrounding chamber. A gas or gaseous mixture flows through the interior of each of the tubes. A second gas or gaseous mixture flows from the surrounding chamber into each tube through the plurality of orifices. As the gas from the surrounding chamber flows into each tube, it mixes with the gas flowing through the tube and this mixture flows into the distributor and from there to the reactor. The size of the internal diameter of the tubes as well as the length of the tubes is designed to produce uniform gas flow through the tubes. The size of the orifices is selected to provide sufficient pressure drop between the surrounding chamber and the tube interior to provide for the desired gas feed rate from the surrounding chamber into the tubes. There is no particular requirement that the orifices be located in a particular position relative to each other. FIGS. 2, 5, and 7 show at least three orifices located around a circumference of each tube. FIG. 2 shows orifices at more than one circumferential location on each tube.

A third mixing apparatus having no internal pans which contribute to the mixing is described by Vollerin et al. in U.S. Pat. No. 4,089,630, issued May 16, 1978. This apparatus mixes two fluids by generating a pressure drop across a pair of surfaces each forming a wall of a mixing chamber and confronting one another, while separating a respective source of fluid from the mixing chamber. The surfaces are provided with mutually aligned and opposing apertures, thereby accelerating the respective gases through the apertures in opposing jets. The resulting mixture of fluids is conducted away from the chamber in a direction substantially parallel to the surfaces. In particular, this mixing apparatus was designed for mixing of a recirculated combustion gas and a combustion-sustaining gas such as air for combustion of the mixture with a combustible gas.

All of the above-described gas-mixing devices employ a gas flowing through an orifice to contact and mix with another gas. There are many examples of the use of orifices in the mixing gases and fluids in general, including a multitude of examples pertaining to carburation. In each case, the apparatus design depends on the end use application and the tasks to be accomplished by the apparatus.

The gas mixing apparatus and method of the present invention was developed for use in the semiconductor industry where it is often desired to create a gas mixture including a very small quantity (parts per million or less) of one component gas, such as a dopant gas. In addition, in many circumstances the gases to be mixed have substantially different densities.

The apparatus used to provide the gas mixture must not contribute particulate contamination to the gas mixture, since it is critical that gases used in semiconductor production have extremely low particulate levels. The presence of particulate contamination can render inoperable a semiconductor device having submicron-sized features. Previously utilized gas mixing apparatus having internal static mixer configurations have not proved satisfactory, due to the generation of particulates. To avoid the generation of particulates, it is helpful that the gas mixing apparatus be free from internal parts which contaminate the gas mixture due to erosion or corrosion of such internal parts.

Many of the dopant gas mixtures used in the semiconductor industry contain dopant constituents at concentrations in the parts per million (ppm) or parts per billion (ppb) range. Further, the dopant constituent typically has a significantly different density from the diluent carrier gas used to transport it into the semiconductor process. Since it is critical to the performance properties of the semiconductor device that the dopant be present at a specified concentration and that it be uniformly distributed, the dopant gas used to supply the dopant must be homogeneous and have proper dopant content. Thus, it is frequently preferred to mix the dopant gas into the diluent carrier gas immediately before use. Further, since some of the dopant constituents are relatively toxic, it is not desirable to mix large quantities of the component gases to obtain a uniform mixture, with excess gas mixture to be discarded; it is preferred to mix small quantities of gas as required for use. Due to the desire to produce small quantities of homogeneous dopant gas mixtures, it is important to have highly turbulent mixing, so that a uniform, homogeneous gas mixture can be obtained rapidly upon contact of the gases to be mixed, even when the relative quantity of one of the gas constituents is small.

The above-described specialized requirements have created a need in the semiconductor industry for a gas mixing apparatus and method which provide for highly turbulent mixing of small quantities of gases, with mixing achieved in an apparatus having minimal to no internal parts to contribute to the generation of particulates.

SUMMARY OF THE INVENTION

In accordance with the present invention, a specialized gas mixing apparatus and method have been developed. In particular, the gas mixing apparatus and method provide turbulent, rapid mixing of gases in a manner which generates minimal particulate contamination of the gas mixture. The gas mixing apparatus comprises:

a) a tubular housing through which the gases to be mixed flow longitudinally from a first end to an opposite end of the housing;

b) at least two orifices or jets located near the first end of the housing, through which gases to be mixed can enter the tubular interior of the housing, wherein the orifices or jets are located on the tubular interior surface so that a first portion of gas flowing from a first orifice or jet will directly impact a second portion of gas flowing from a second orifice or jet, whereby frictional mixing of the gas components is achieved, and wherein the axis of the first orifice or jet is offset from the axis of the second, opposing orifice or jet so as to produce a swirling action within the tubular interior of the gas mixer; and c) a gas mixture exit opening at the opposite end of the tubular housing.

DETAILED DESCRIPTION OF THE PREFERRED EMBODIMENTS

Figure 1:
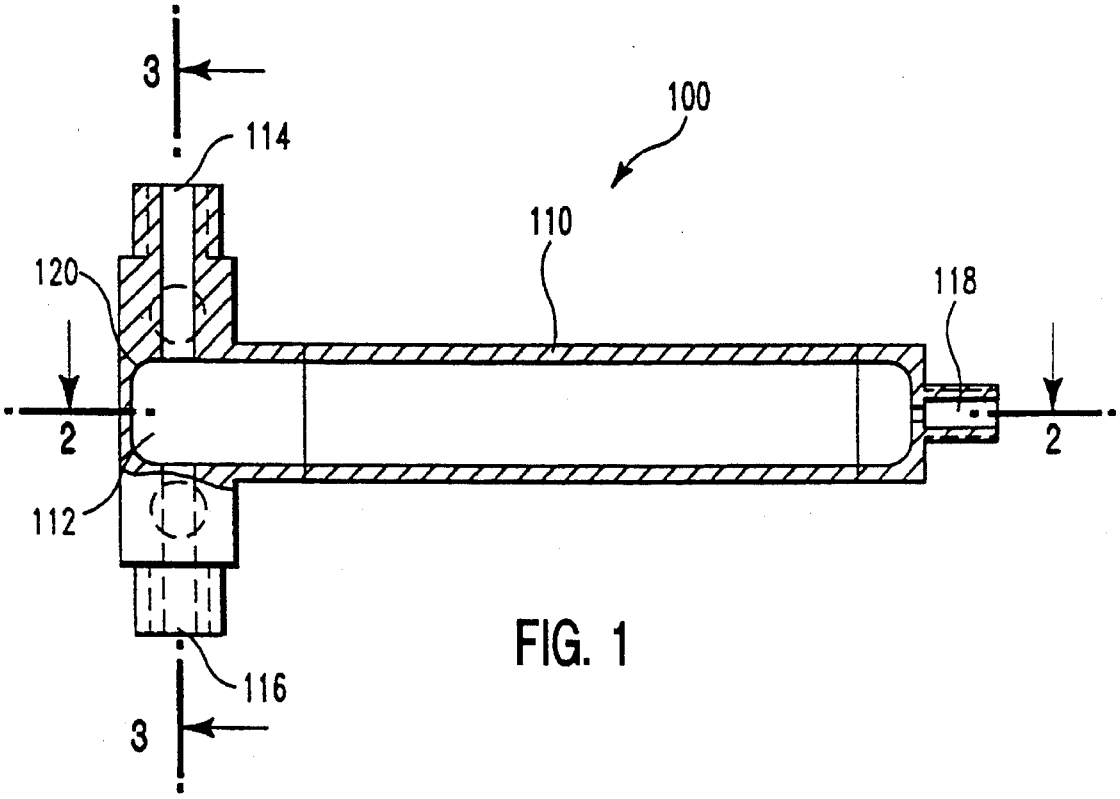
FIG. 1 is a longitudinal cross-sectional view of a preferred embodiment of the apparatus of the present invention.

Referring to FIG. 1, the illustrated gas mixing apparatus 100 according to the present invention has a housing 110 which provides an interior tubular chamber 112, a first gas entry channel 114, a second gas entry channel 116, and a gas mixture exit channel 118. The gas entry channels are shown as terminating in simple orifices 310 and 312 because this is the most simple and preferred opening; however, a more complex jet can be used in place of a simple orifice.

Figure 2:
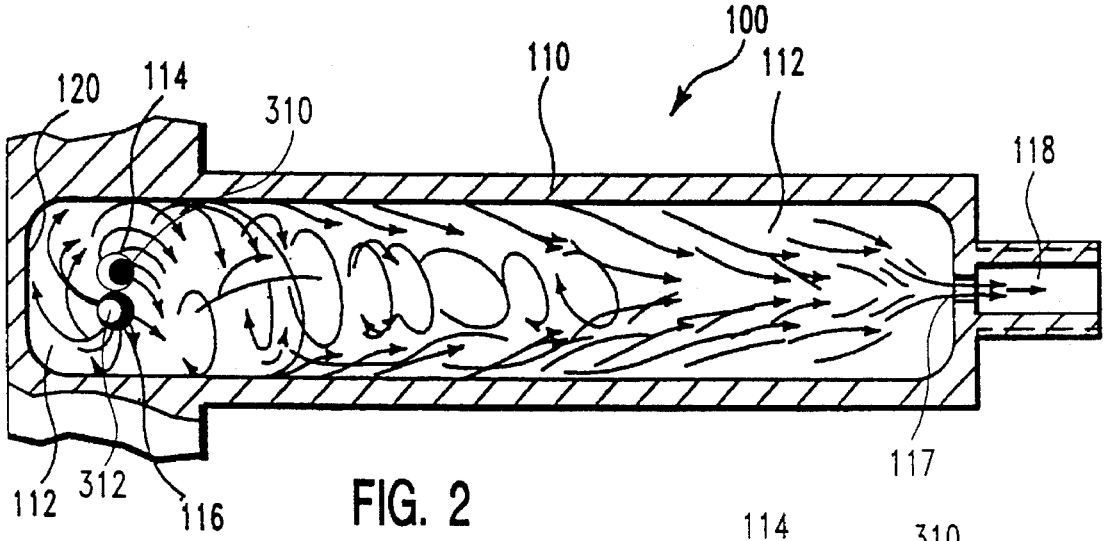
FIG. 2 is another longitudinal sectional view taken along section lines 2—2 of the apparatus shown in FIG. 1
Figure 3:
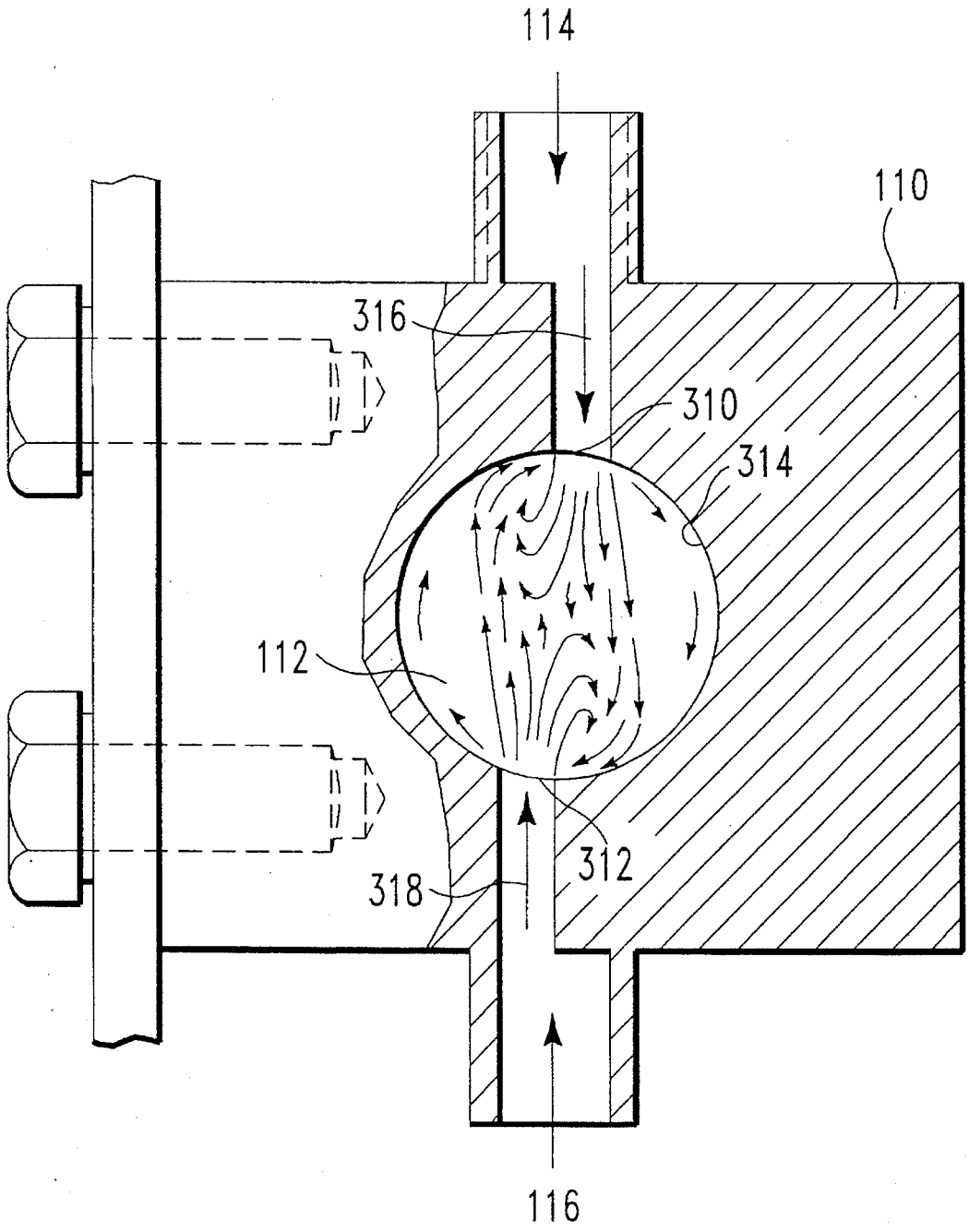
FIG. 3 is a transverse sectional view taken along section lines 3—3 of the apparatus shown in FIG. 1. Arrows in the figure show schematically the turbulent mixing of gases.

With reference to FIG. 3, a first gas (or gas mixture) flows through channel 114 and orifice 310 into tubular chamber 112, while a second gas (or gas mixture) flows through channel 116 and orifice 312 into tubular chamber 112. As the gases pass through the orifices, they expand into cone-shaped flow patterns. Since the centerline or axis 316 of orifice 310 is laterally offset from the centerline 318 of orifice 312, portions of the cone-shaped flow patterns overlap in the central area of tubular chamber 112, while other portions of the cone-shaped gas flow from each orifice do not overlap, but flow toward the tubular wall, as shown in FIG. 3. The gases in the overlapping portion of the gas flows directly impact each other, creating a shear plane in which turbulent mixing occurs; the gas flows which do not overlap create a swirling force which operates adjacent the tubular interior surface 314. The combination of frictional mixing in the shear plane of directly impacting gases and the swirling force created along interior surface 314 of tubular chamber 112 produces a form of turbulent gas mixing which provides a homogeneous gas mixture in a surprisingly rapid time period, even when the overall volumetric flow rate of the gases is small (liters per minute, for example). As shown in FIG. 2, the degree of turbulence decreases as the gas mixture flows through the length of the tubular chamber 112 toward the exit channel 118.

Figure 4:
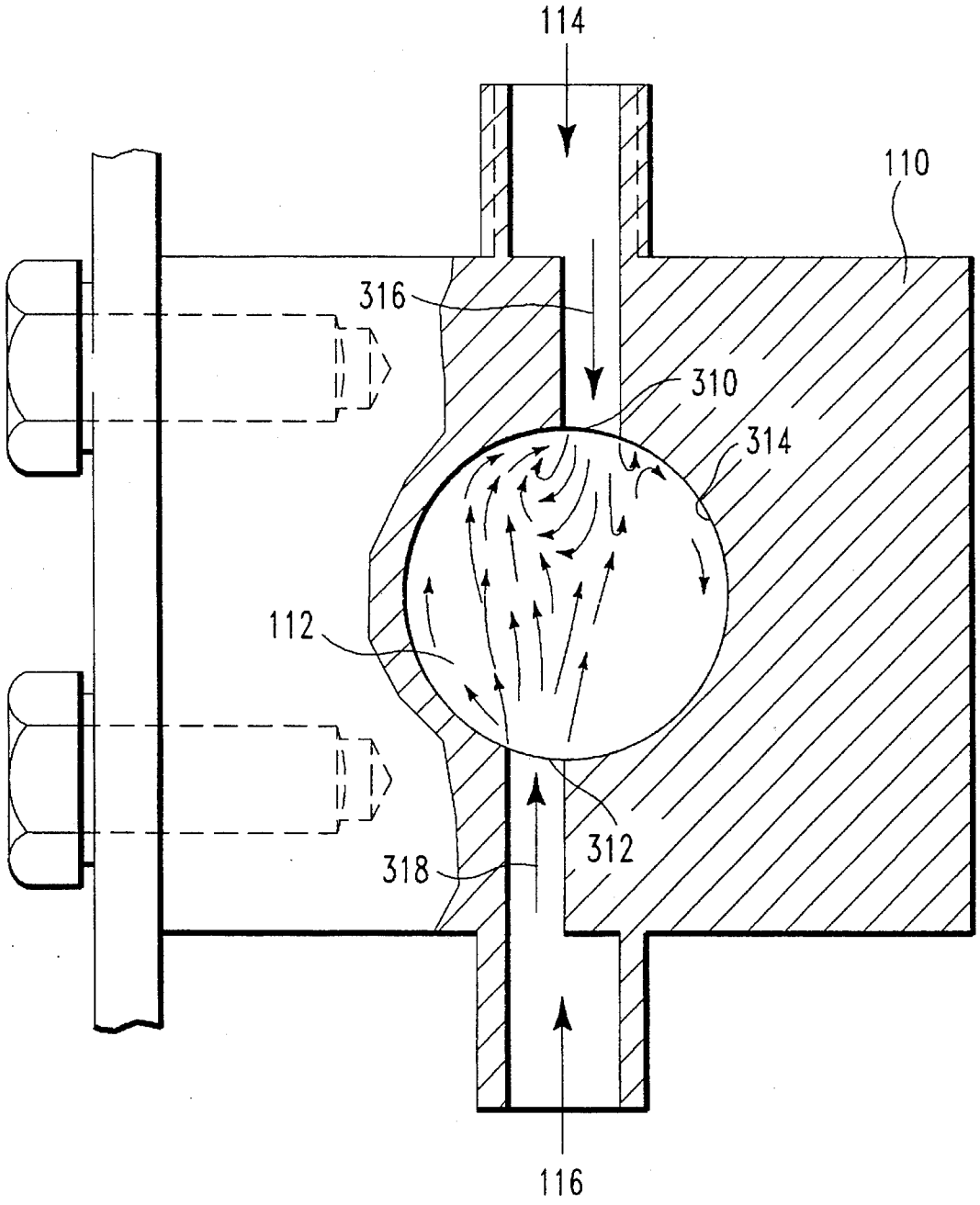
FIG. 4 is the same view as FIG. 3, but having arrows showing schematically the gas turbulence pattern when the two opposing gas flows have considerably different momentums.

The arrows in FIG. 3 illustrate the gas turbulence pattern when the density and velocity of the gas exiting orifice 310 are essentially the same as the density and velocity of the gas exiting orifice 312. Thus, the shear plane of the directly impacting gases is evenly distributed across the cross-sectional area of the tubular chamber 112. However, should the density and/or velocity of the gas entering either orifice be substantially different, the flow pattern of the gases will be affected. For example, FIG. 4 illustrates the change in mixing dynamics when the momentum of the gas entering orifice 310 is less than the momentum of the gas entering orifice 312. This difference in momentum will occur if orifice 310 and orifice 312 are the same size, and if either: 1) the densities of the gases to be mixed are significantly different; or 2) the volumetric flow rates of the gases are significantly different, resulting in a lower velocity of the gas being introduced at the lower volumetric flow rate.

The lower momentum of the gas entering orifice 310, as shown in FIG. 4, results in a shifting of the shear plane formed by the direct impacting of the gases. The area of the shear plane is reduced due to the change in flow dynamics. Thus, it is less desirable from a shear plane mixing standpoint to have the momentum of one gas entering the mixer be lower than that of the other gas to be mixed.

Figure 5:
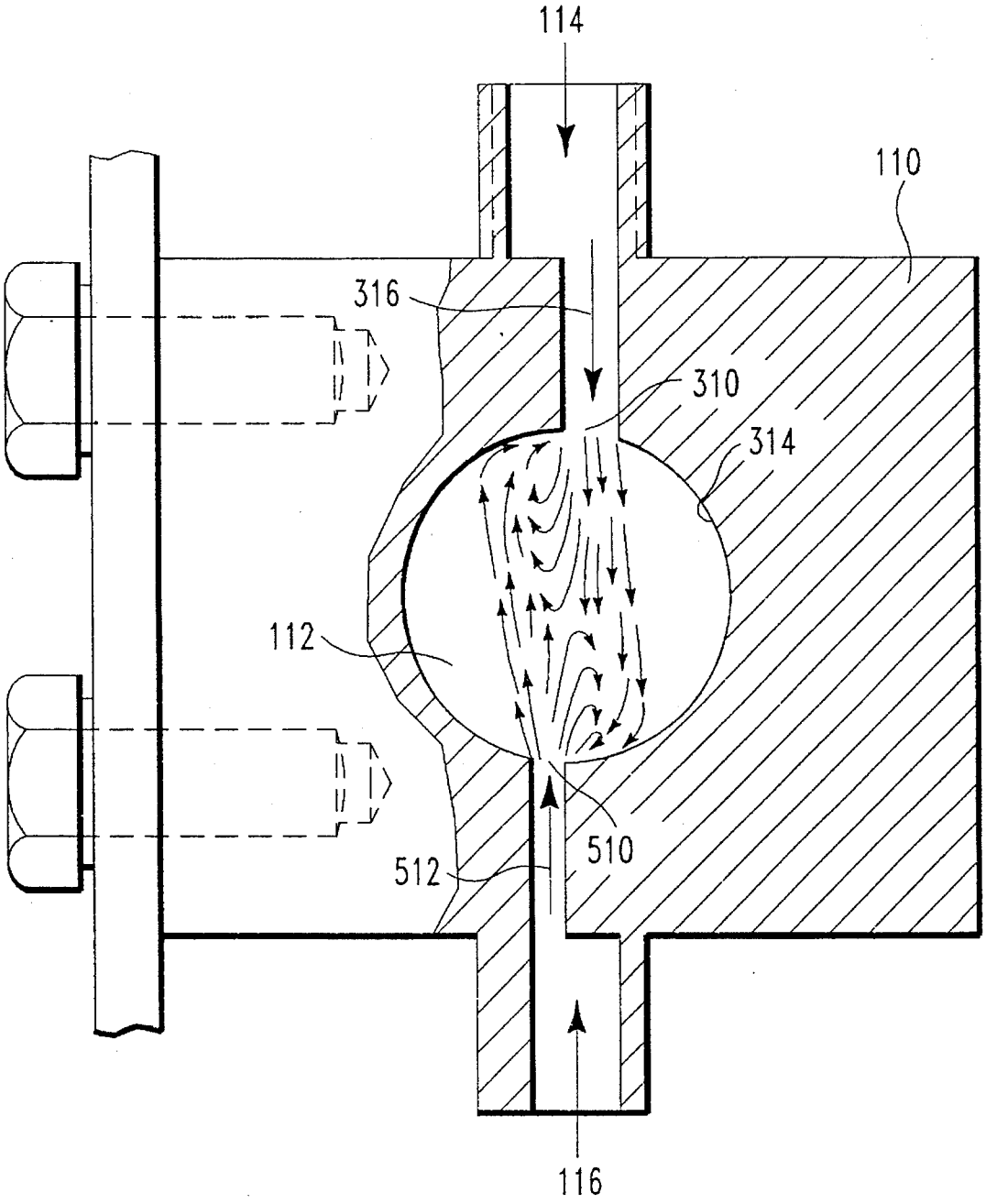
FIG. 5 illustrates an alternative embodiment wherein the opposing orifices have different diameters.

FIG. 5 shows an alternative embodiment of gas mixing apparatus 100 in which the first entry channel 114 has an orifice 310 which is larger than the orifice 510 of the second entry channel 116. This embodiment is preferred to equalize the momentums of the two opposing gas streams when their respective densities or volumetric flow rates are different. Specifically, the smaller orifice 510 increases the velocity, and therefore the momentum, of the second gas stream entering the chamber 112, which is desirable when the second gas has a lower density or lower volumetric flow rate than the first gas.

With reference to FIG. 3, when a gas enters mixing apparatus 100 through orifice 310 having a circular cross-sectional area, the gas typically extends out from the orifice into tubular chamber 112 in the form of a cone wherein the unbounded cone wall surface forms an angle of approximately seven degrees with the orifice centerline. Thus, one skilled in the art can obtain a shear plane of directly impacting gas streams while providing a swirling force adjacent tubular surface 314, by offsetting centerline 316 of orifice 310 from centerline 318 of orifice 312 by an amount such that a portion of the extended cones intersect. The amount of offset can be optimized, using minimal experimentation, for a given tubular chamber 112 diameter and given orifice 310 and 312 diameters, to obtain a balance between direct impact mixing over the shear plane area and the creation of a swirling force adjacent tubular surface 314. One skilled in the art can optimize the design variables by adjusting the amount of offset and analyzing the uniformity of the gas composition exiting mixing apparatus 100.

When a gas enters mixing apparatus 100 through a complex jet rather than a simple orifice, the cone-shaped extension of gas flow may form an angle from the centerline of the jet which is greater than or less than the approximately seven degree angle generated by a circular orifice. The offsetting of jet centerlines can then be adjusted to account for this difference.

Although the illustrated preferred embodiment has two parallel, coplanar gas entry channels which are laterally offset from each other to produce the desired turbulence and swirling, a similar effect can be achieved using other orientations for the gas entry channels and orifices. For example, the two orifices could be diametrically opposed rather than laterally offset, but with the axis of each gas entry channel formed at an angle to a radius of the tubular chamber 112 so that the two gas streams entering chamber 112 strike each other obliquely.

The portion of tubular chamber 112 extending between the gas mixture exit opening 118 and the entry orifices 114 and 116 preferably has a length at least three times its interior diameter. The short distance between the closed end 120 of the gas mixer and the gas entry orifices 114 and 116 should be great enough to permit extension of the cone-shaped flow pattern from the orifices 114 and 116, but not so great as to leave a dead space at the closed end 120 of the gas mixer.

The preferred entry orifice diameter is less than one-fifth of the diameter of the tubular interior.

The sizing of the exit opening must be adequate to accommodate the amount of gas entering through the orifices or jets near the opposite end of the mixer; otherwise pressure will build within the mixer. It is preferred that the mixed gases exit the mixing apparatus at a volumetric rate which avoids creation of a backpressure detrimental to the flow dynamics of the mixer. Preferably the diameter of the mixed gas exit orifice is of approximately the same magnitude as that of a gas entry orifice.

The invention is particularly useful when the gases to be mixed have significant density differences and when it is important that the gas mixture be homogeneous at the time it is used. The apparatus of the present invention can be used to mix gases which are stored for later use, but is particularly advantageous in the in-line mixing of gases just prior to use.

Typical gases used in the semiconductor industry as dopants include, for example, boron hydrides, particularly diborene ($B_2H_6$); arsenic compounds, particularly arsine ($AsH_3$); and phosphorus trihydride ($PH_3$). Such gases have a density ranging from about 1.2 g/l to about 7.7 g/l at STP. These dopant gases are diluted to a desired concentration in a carrier gas with which they will not react. Typical diluent carrier gases include hydrogen, nitrogen, argon, and helium. These diluent, carrier gases have densities ranging from approximately 0.09 g/l to about 1.8 g/l at STP.

Dopant gases are frequently used in semiconductor processes at concentrations in the parts per million (ppm) to parts per billion (ppb) range. Further, since the performance of the semiconductor device depends on the concentration of dopant in a material layer created using the dopant gas, the composition of the dopant gas must be carefully controlled. For example, the resistivity of a deposited layer containing a dopant can be affected by about 1% due to a change in dopant concentration of about 1%. Since the dopant gas contains only ppm to ppb of the dopant, a slight separation of components within the gas mixture due to density differences can have a significant effect. Not only can the resistivity of a deposited layer be different from the desired value, but the resistivity can vary from point to point on a layer surface, which is particularly harmful to the operation of the fabricated semiconductor device. For example, specifications for semiconductor devices typically require resistivity uniformity to within about ±3 percent. Thus, a 5 percent change in dopant concentration or a 5% variation in the uniformity of the dopant gas concentration is not acceptable. With this in mind, when there is any tendency toward nonuniformity within a gas mixture upon standing, it is preferred that dopant gases be diluted to the desired concentration using in-line mixing and used in the process for which they are intended immediately after mixing.

The velocity of a gas exiting an orifice in the mixing apparatus of the present invention is preferably less than about 300 ft/sec (91.4 m/sec) Above 300 ft/sec (91.4 m/sec) it is possible to have compressible flow which can result in adiabatic heating or cooling.

To produce a desired gas mixture composition, it may be necessary to design the orifice size for each gas to be mixed to ensure the desired relative velocities. Another method of obtaining the desired gas mixture composition is to use several in-line turbulent gas mixers, wherein the gas mixture exiting one mixer is used as the feed gas to a subsequent in-line turbulent gas mixer. Typically the gas mixing is carried out over a temperature range from about 15° C. to about 30° C. The typical average operational pressure ranges from about atmospheric pressure to about 10 torr. A chemical vapor deposition process chamber widely used in the industry operates at about 80 torr. A plasma chamber can operate at pressures as low as 0.5 torr, however. The gas mixing obtained is relatively independent of the operational pressure of the mixer. Although a lower operational pressure results in a higher volume expansion of gases entering the mixer, there is a corresponding reduction in residence time of gases within the mixer since the gases are typically drawn toward the low pressure source, the semiconductor process chamber in which the dopant gas mixture is used. The volume of the gas mixture exiting the turbulent gas mixer is designed to correspond with the additive volumes of the gases or gas mixtures entering the gas mixer. It is the desired relative volumetric flow rates and relative velocities of the gases at the mixer orifices which determines the sizes of the orifices and the dependent gas mixture opening size.

Although the chamber 112 has been described as tubular, the cross section of the chamber need not be circular, and the longitudinal axis of the chamber may be curved rather than straight.

The material of construction of the tubular housing of the gas mixer and of each orifice or nozzle should be such that no reaction occurs between a gas component to be mixed and the material of construction. Preferably surfaces within the gas mixer should be smooth to reduce particulate generation or entrapment.

EXAMPLE 1

Figure 2A:
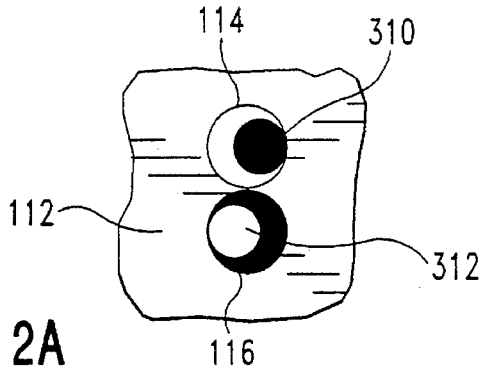
FIG. 2A is an enlargement illustrating the gas entry portion of the apparatus shown in FIG. 2.

The gas mixing apparatus was a tubular having a circular cross-section, as shown in FIGS. 1–3. The overall length of the tubular-shaped mixing chamber was about 2.8 inches (71.1 mm). The internal diameter of the mixing chamber was 0.41 inches (10.4 mm). The gases to be mixed entered the mixing chamber, as shown in FIG. 2, through orifices located about 0.2 inches (5 mm) from a closed end (120) of the mixing chamber (112). The mixed gases exited the mixing chamber at the opposite end of the tubular through an exit opening 117 centered in that end of the tubular. The exit opening diameter was about 0.076 inches (1.9 mm). The orifices 310 and 312 through which the gases to be mixed entered the tubular-shaped mixing chamber were each about 0.052 inches (1.3 mm) in diameter. Each orifice was located on the interior surface of the tubular mixing chamber, as shown in by the combination of illustrations in FIG. 2, FIG. 2A and FIG. 3, such that the centerlines (316 and 318) of the orifices (310 and 312, respectively) were coplanar, this plane being transverse to the longitudinal axis of the tubular-shaped mixing chamber (112). The orifices were positioned in opposition to each other with the centerline (316) of one orifice being parallel to and offset from the centerline (318) of the other orifice by about 0.1 inches (2.5 mm).

Two hundred and forty (240) sccm of a gas mixture consisting of 50 ppm arsine ($AsH_3$) in hydrogen ($H_2$) was fed into the mixer, as shown in FIG. 3, through one orifice (310) while 2,000 sccm of hydrogen was fed into the mixer through the opposing orifice (312). The operational temperature of the mixer was about 20° C. and the operational pressure within the mixing chamber was about 100 torr.

EXAMPLE 2

The gas mixing apparatus was the same as that described in Example 1 except that the diameter of the orifices through which the gases entered were each about 0.076 inches (1.9 mm).

Sixty (60) sccm of a gas mixture consisting of 50 ppm arsine in hydrogen was fed into the mixer through one orifice while 8,000 sccm of hydrogen was fed into the mixer through the opposing orifice. The operational temperature of the mixer was about 25° C. and the operational pressure was about 760 torr.

The preferred embodiments of the present invention, as described above for the preferred embodiments and shown in the FIGS. are not intended to limit the scope of the present invention, as demonstrated by the claims which follow, since one skilled in the art can, with minimal experimentation, extend the scope of the embodiments to match that of the claims.

What is claimed is:

1. A method for the turbulent mixing of gases, comprising the steps of:

a) causing each gas or gas mixture which is to be mixed to flow through an orifice or jet into a tubular enclosure in which said turbulent mixing occurs;

b) positioning each orifice or jet along the surface of said tubular enclosure so that a portion of the gas or gas mixture flowing from one of said orifices or jets forms a cone shaped pattern having a flow which impacts directly an overlapping portion of flow from a cone shaped pattern of a different gas or gas mixture flowing from an opposing orifice or jet, with the remaining portion of gas or gas mixture flow from each of the opposing orifices or jets, which does not overlap, continuing to flow toward a surface of said tubular enclosure, whereby a swirling action is created adjacent said surface of said tubular enclosure; and c) causing a mixture of gases created in step b) to flow through said tubular enclosure for a distance necessary to provide a gas mixture having the desired uniformity of composition, under conditions which avoid compressible flow.

2. The method of claim 1, including an additional step: causing said mixture of gases from step c) to flow through an additional orifice having a diameter of approximately the same magnitude as that of one of said gas entry orifices or jets, to exit said tubular enclosure.

3. A method for the turbulent mixing of gases or gas mixtures, comprising the steps of:

a) causing each gas or gas mixture which is to be mixed to flow through an orifice or jet into a single tubular enclosure in which said turbulent mixing occurs;

b) positioning each orifice or jet along the surface of said tubular enclosure so that at least a portion of the gas or gas mixture flowing from one of said orifices or jets forms a cone shaped pattern having a flow which directly opposes an overlapping portion of flow from a cone shaped pattern of a different gas or gas mixture flowing from another of said orifices or jets in a manner which provides direct and first impact of said portions of gases or gas mixtures from said opposing orifices or jets, with the remaining portion of gas or gas mixture flow from each of the opposing orifices or jets, which does not overlap, and mixed portions of said directly impacted gases flowing toward a surface of said tubular enclosure, whereby a swirling action is created adjacent said surface of said tubular enclosure; and c) causing a mixture of gases created in step b) to flow through said tubular enclosure for a distance necessary to provide a gas mixture having the desired uniformity of composition, under conditions which avoid compressible flow.

* * * * *